US006257780B1

(12) United States Patent
Ito et al.

(10) Patent No.: US 6,257,780 B1
(45) **Date of Patent: *Jul. 10, 2001**

(54) INK RIBBON CARTRIDGE HAVING ONE UNDETACHABLE SPOOL AND IDLE ROTATION PREVENTING STRUCTURE

(75) Inventors: Shingo Ito, Tajimi; Yoshikatsu Kameyama, Gifu-ken, both of (JP)

(73) Assignee: Brother Kogyo Kabushiki Kaisha, Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/225,482

(22) Filed: Jan. 6, 1999

(30) Foreign Application Priority Data

Jan. 6, 1998 (JP) ..... 10-000869
Jan. 29, 1998 (JP) ..... 10-017042

(51) Int. Cl.[7] ..... B41J 35/28

(52) U.S. Cl. ..... 400/208; 400/208.1; 400/246; 400/693.1; 242/338.3; 242/343; 242/599; 242/609.1

(58) Field of Search ..... 400/207, 208, 400/208.1, 224.2, 236.2, 242, 246, 693.1; 242/338.3, 343, 599, 599.1, 609.1

(56) References Cited

U.S. PATENT DOCUMENTS

| | | | | |
|---|---|---|---|---|
| D. 425,545 | * | 5/2000 | Ishida | D18/12 |
| 4,029,268 | * | 6/1977 | Schoettle et al. | 242/338.3 |
| 4,687,358 | * | 8/1987 | Saitou | 400/208 |
| 4,914,452 | | 4/1990 | Fukawa . | |
| 4,973,983 | | 11/1990 | Yamamoto et al. . | |
| 5,100,250 | * | 3/1992 | Suzuki et al. | 400/208 |
| 5,110,228 | * | 5/1992 | Yokomizo | 400/208 |
| 5,374,007 | * | 12/1994 | Murison | 242/538.2 |
| 5,378,072 | | 1/1995 | Gunderson | 400/236 |
| 5,455,617 | * | 10/1995 | Stephenson et al. | 400/208 |
| 5,547,298 | * | 8/1996 | Wouters et al. | 400/207 |
| 5,741,080 | * | 4/1998 | Tomoda et al. | 400/208 |
| 5,897,256 | * | 4/1999 | Kameyama | 400/208 |

FOREIGN PATENT DOCUMENTS

| | | |
|---|---|---|
| 0 423 647 A2 | 4/1991 | (EP) . |
| 0 466 186 A2 | 1/1992 | (EP) . |
| 0 475 404 A2 | 3/1992 | (EP) . |
| 0 593 821 A1 | 4/1994 | (EP) . |
| 0 658 435 A1 | 6/1995 | (EP) . |
| 0 852 183 A2 | 7/1998 | (EP) . |
| 2 314810 | 1/1998 | (GB) . |
| 61-213181 | 9/1986 | (JP) . |
| 6-81749 | 11/1994 | (JP) . |
| 8-276630 | 10/1996 | (JP) . |

* cited by examiner

*Primary Examiner*—John S. Hilten
*Assistant Examiner*—Leslie J. Grohusky
(74) *Attorney, Agent, or Firm*—Oliff & Berridge, PLC

(57) ABSTRACT

An ink ribbon is formed form a belt shaped sheet body, and is wound around a pair of tubes. Spools are detachably mounted at each end of the tube bodies. An ink ribbon cartridge includes side plates formed with supporting openings for supporting corresponding spools. Each supporting opening is formed with a cutout portion defined by edges. When the ink ribbon cartridge is mounted in a facsimile machine, the spools are freely rotatable within the supporting openings. On the other hand, when the ink ribbon cartridge is dismounted from the facsimile machine, engagement protrusions formed to the spools catch on the edges defining the cutout portions, thereby preventing the spools form rotating. As a result, the ink ribbon will not unintentionally greatly loosen.

17 Claims, 15 Drawing Sheets

46
35a
51a
57
46a
55a
44a
46a
36a
550
46a
56
43a
35
53

57
35b
44c
56
46c
550
46c
55c
46c
43c
36c
51c

INK RIBBON CARTRIDGE HAVING ONE UNDETACHABLE SPOOL AND IDLE ROTATION PREVENTING STRUCTURE

BACKGROUND OF THE INVENTION

1. Field of the Invention

The present invention relates to an ink ribbon cartridge for use in a recording device, and more specifically to an ink ribbon cartridge including an exchangeable ink ribbon having a broad width.

2. Description of the Related Art

When printing is performed for forming an image on a plain paper using a thermal printer, normally an ink ribbon cartridge is used because it is easy to exchange and simple to handle. Usually, an ink ribbon cartridge includes a broad-width ink ribbon when the thermal printer is a thermal line printer.

In such an ink ribbon cartridge, the ink ribbon is wound around a supply tube and extends to a takeup tube. An ink layer is formed on one surface of the ink ribbon. A spool without a gear is provided atone end of each of the supply tube and the takeup tube, and a spool with a gear is provided at other end of each of the supply tube and the takeup tube. All the spools are provided with a flange. The supply tube and the takeup tube are rotted in their circumferential direction by driving force transmitted via the gears.

When an ink ribbon cartridge is removed from the printer or placed by itself on a tale top, for example, or when an operator picks up the ink ribbon cartridge and moves it around, the ink ribbon can undesirably loosen because the spools become freely rotatable with respect to the cartridge case.

Japanese Patent-Application Publication (Kokai) No. HEI-8-276630 discloses configuration for overcoming this problem. Specifically, a pair of tubular spools on which an ink ribbon is wound are rotatably supported in a cartridge case. A compression coil spring is interposed between one end of each spool and first side wall of the cartridge case. The other end of each spool is formed with a groove engageable with an protrusion formed in an opposite second side wall of the cartridge case. The configuration is provided for moving the spools toward the first side wall so the protrusions and grooves fall out of engagement when the ink ribbon cartridge is mounted in a printer.

On the other hand, when the ink ribbon cartridge is removed from the printer, force of the compression coil spring moves the spools in their axial directions, and the protrusions engage with the grooves, thereby preventing the spools from rotating. In this way, the ink ribbon is prevented from loosening.

Also, Japanese Utility-Model-application Publication (Kokai) No. HEI-6-81749 discloses another type of ink ribbon cartridge. A pair of spools on which an ink ribbon is wound are freely rotatably supported in internal of a cartridge case. A compression coil spring is interposed between one end of each spool and a first side wall of the cartridge case. A flange with a large diameter is provided to the other end of the each spool. A friction plate is adhered either an outer surface of each of the flanges an opposite second side wall of the cartridge case confronting the outer surface of each flange.

With this configuration also, when the ink ribbon cartridge is removed from a printer, force of the compression coil springs move the spools in their axial directions, so that the outer surface of each flange is brought into pressing contact with the second side wall of the cartridge case, thereby preventing the spools from undesirably rotating. Therefore, the ink ribbon will not loosen.

However, with this configuration, operations for exchanging the ink ribbon are troublesome. That is to say, when the spools with a spent ink ribbon are removed from the cartridge case, there is a danger that the compression coil springs will fall off the cartridge case. Even if the compression coil springs do not separate from the cartridge case, in order to remove the spools from the cartridge, the compression coil springs need to be once greatly compressed. Further, when mounting the spools with an unused ink ribbon into the cartridge case, the spools cannot be mounted in the compression coil springs unless the compression coil springs are once greatly compressed. For these and other reasons, the existence of the compression coil springs makes operations for exchanging the ink ribbon troublesome.

When the spools are replaced each time a spent ink ribbon is replaced, this wastes resources and increases the costs. Therefore, the spools are removed from the supply tube and the takeup tube with the present ink ribbon, and mounted onto new supply tube and takeup tube with a fresh ink ribbon, and then mounted back into the cartridge case. At this time, the geared spools must be set at correct ends of the supply tube and the takeup tube and at correct locations in the cartridge case, otherwise the ink ribbon will not be arranged in a correct orientation in the cartridge case.

SUMMARY OF THE INVENTION

It is conceivable to form one of the spools in a different shape than the other three spools and form one end of the tube bodies so that it will fit only the odd shaped spool. In addition, it is conceivable to form one of the spool flanges with a diameter greater than the other three spool flanges so that the odd shaped spool flange can only fit into a certain supporting hole formed to the cartridge case. With this conceivable configuration, the ink ribbon will not be mounted erroneously in the cartridge case.

However, even with this conceivable configurations, each time an ink ribbon is exchanged, an operator must check to find the spool with the large diameter and then find the corresponding mounting location in the cartridge case. Alternatively, the user may just keep trying to mount the ink ribbon in the cartridge case until he hits on the right flange and mounting location combination. This is troublesome and time consuming.

It is an objective of the present invention to overcome the above-described problems and to provide a simple configuration of an ink ribbon cartridge wherein an ink ribbon can be prevented from undesirably loosening.

It is an another objective of the present invention to provide a simple configuration of an ink ribbon cartridge wherein operations for ink ribbon replacement can be performed quickly and accurately.

In order to achieve the above and other objective, there is provided an ink ribbon cartridge including a case, a first spool, a second spool, a third spool, a fourth spool, a first tube, a second tube, and an ink ribbon. The case has first and second plates facing each other. The first plate is formed with first and second openings each with a cutout portion. The second plate is formed with third and fourth openings. The first and the second spools are detachably rotatably mounted in the first and second openings, respectively. The third and fourth spools have a gear and detachably rotatably mounted in the third and fourth openings, respectively. The first tube has a first end and a second end opposite form the first end. The first and second ends are detachably engaged with the first and the second spools, respectively. The second tube has a third end and a fourth end opposite from the third end. The third and fourth ends are detachably engaged with the second and fourth spools, respectively. The ink ribbon is wound around the first tube and the second tube.

There is also provided an ink ribbon cartridge including a case, two pairs of a right spool and a left spool each having a supporting shaft. The case has two pairs of a right side plate and a left side plate each formed with an opening with a cutout portion defined by edges. The right and left spools are detachably rotatably mounted in corresponding openings. The supporting shaft of either one of the right and left spools has a peripheral surface formed with at least one protrusion for catching on the edges defining the cutout portion.

BRIEF DESCRIPTION OF THE DRAWINGS

The particular features and advantages of the invention as well as other objects will become more apparent from the following description taken in connection with the accompanying drawings, in which:

FIG. 8(*b*) is a left side view of the ink ribbon cartridge;

FIG. 9(*b*) is an enlarged side view of a protruding rib formed in the spools;

FIG. 10(*b*) is a side view showing the support opening and the support portion of FIG. 10(*a*);

FIG. 13(*b*) is a left side view of the ink ribbon cartridge shown in FIG. 11;

FIG. 14(*b*) is a plan view of the spool of FIG. 14(*a*);

FIG. 15(*b*) is an another plan view of the portion of the spool shown in FIG. 15(*a*);

FIG. 16(*b*) is an another plan view of the spool shown in FIG. 16(*a*);

DETAILED DESCRIPTION OF THE PREFERRED EMBODIMENTS

An ink ribbon cartridge according to preferred embodiments of the present invention will be described while referring to the accompanying drawings. In the following description, the expressions "front", "rear", "left", "right", "upper", and "below" are used throughout the description to define the various parts when the printer is disposed in an orientation in which it is intended to be used.

First, a general configuration of a facsimile machine 1 in which an ink ribbon cartridge of the present invention is used will be described while referring to FIG. 1. It should be noted that the facsimile machine 1 shown in FIG. 1 functions both as a facsimile machine and as a printer. Specifically, the facsimile machine 1 retrieves images from a document 8, and transmits image data to another facsimile machine over a telephone circuit. The facsimile machine 1 also receives image data from remote facsimile machines and forms images on recording sheets 4 accordingly. Further, the facsimile machine 1 receives print data transmitted from a word processor or a personal computer over a printer cable or some wireless configuration, such as infrared ray transmission system, and forms an image on the recording sheet 4 based on the print data.

Figure 1:
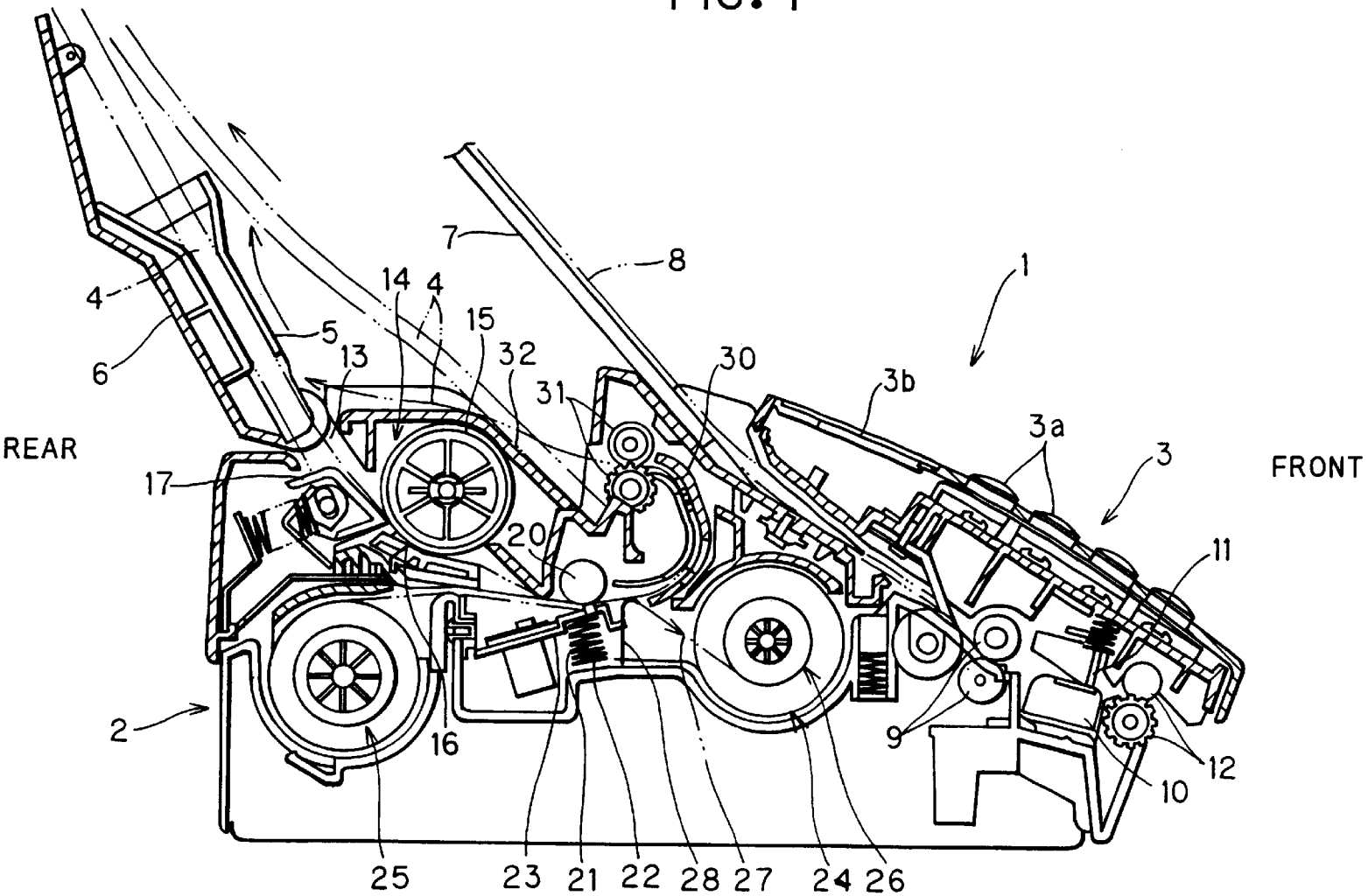
FIG. 1 is a cross-sectional view of a facsimile machine including an ink ribbon cartridge according to a first embodiment of the present invention.

As shown in FIG. 1, the facsimile machine 1 includes a main case 2, an operation panel 3, a pair of sheet guides 5, a cover 6, and a document tray 7. The operation panel 3 is provided at the upper forward portion of the main case 2 and includes key switches 3*a* and liquid crystal display 3*b*. The cover 6 is pivotably disposed at the rear of the main case 2 and is for covering the upper side portion of the main case 2 when closed. The pair of the sheet guides 5 are provided to an inner surface of the cover 6 and are for supporting a stack of recording sheets 4 in a slanting upright posture. The document tray 7 is detachably mounted to the upper surface of the main body 2 at a central position between the front and rear of the main case 2 and supports a document 8.

The facsimile machine 1 also includes, a pair of feed rollers 9 a contact image scanner (CIS) 10, a document pressing body 11, a pair of discharge rollers 12, and a sheet supply unit 14. The feed rollers 9 are provided internally to the main body 2 beneath the operation panel 3 and are feeding the document 8 from the document tray 7 in a document feed direction. The CIS 10 is disposed downstream side of the feed rollers 9 in the document feed direction and is retrieving images formed on the document 8. The discharge rollers 12 are rotatably disposed for discharging the document 8 out from the main body 2.

The sheet supply unit 14 is provided beneath the sheet guides 5 and includes a sheet supply roller 15, a separation pad 16, and a pressing member 17. The sheet supply roller 15 feeds, from a sheet supply port 13, one recording sheet 4 at a time in a sheet feed direction. The separation pad 16 is disposed below the sheet supply roller 15 and urges the sheet supply roller 15 using a spring (not shown). The pressing member 17 presses the recording sheets 4 stacked on the cover 6 against the sheet supply roller 15 from a position upstream from the separation pad 16 in the sheet feeding direction.

Further, the facsimile machine 1 includes a recording portion disposed below the sheet feed roller 15. The recording portion includes a roller-shaped platen 20, a spring 21, a thermal head 22, a print mount 23, and an ink ribbon cartridge 24. The thermal head 22 is disposed below the platen 20 and urged by the spring 21 toward the platen 20. The thermal head 22 has a plurality of thermal elements for generating heat when energized. The ink ribbon cartridge 24 is disposed over the print mount 23.

The ink ribbon cartridge 24 includes a supply spool 25, a takeup spool 26, and an ink ribbon 27. The supply spool 25 is disposed at a rear portion of the ink ribbon cartridge 21 and the takeup spool 26 is disposed in front of the supply spool 25. The ink ribbon 27 is wound around the supply spool 25 and the takeup spool 26, and has one ink surface on which an ink layer is formed. A portion of the ink ribbon 27 extends from the supply spool 25 to the takeup spool 26, passing above the upper surface of the thermal head 22 and a plate spring tension body 28, with the ink layer facing upward.

A recording sheet 4 is fed from the sheet guide 5 to a position between the platen 20 and the thermal head 22 while confrontation with the ink layer of the ink ribbon 27. An image is formed one line at a time on the recording sheet 4 by energizing the thermal elements of the thermal head 22 according to image data. Afterwards, the recording sheet 4 is discharged onto a discharge portion 32 provided at the upper surface of the sheet supply portion 14 by the sheet discharge pad 30 and a pair of sheet discharge rollers 31.

Although not shown in the drawings, a handset is disposed at one side of the main body 2 of the facsimile machine 1.

Next, a configuration of an ink ribbon cartridge 24 according to the first embodiment of the present invention will be described while referring to FIGS. 2 to 8(*b*).

Figure 2:
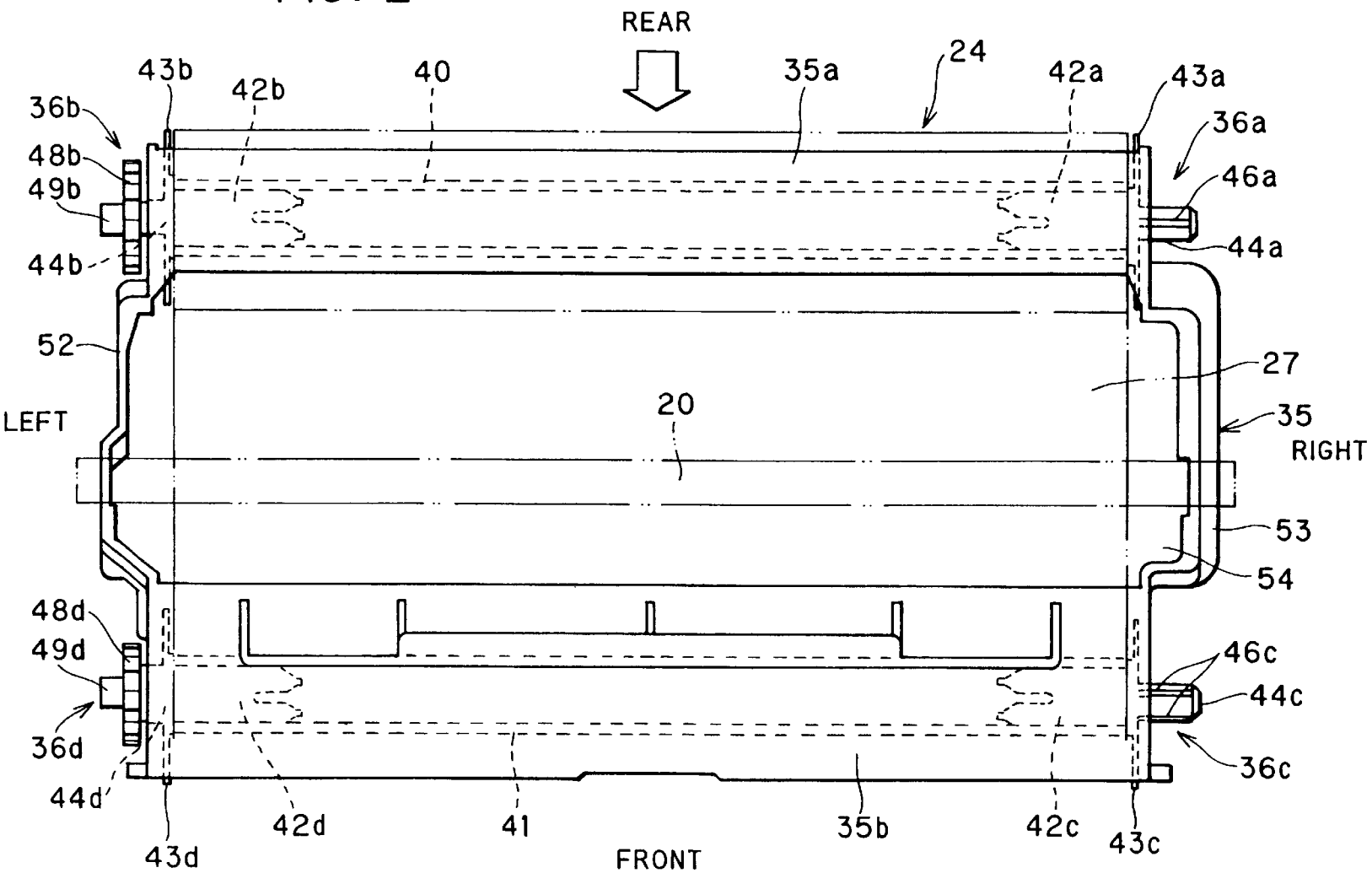
FIG. 2 is a plan view of the ink ribbon cartridge according to the first embodiment of the present invention.

As shown in FIG. 2, the ink ribbon cartridge 24 includes a cartridge case 35, the ink ribbon 27, a pair of right and left supply spools 36*a*, 36*b*, a pair of right and left takeup spools 36*c*, 36*d*, a cylindrical supply tube 40, and a cylindrical takeup tube 41. Each of the supply tube 40 and the takeup tube 41 has right and left ends. The supply spools 36*a*, 36*b* are fitted into the right and left ends of the supply tube 40, respectively, and the takeup spools 36*c*, 36*d* are fitted into the right and left ends of the takeup tube 41, respectively. It should be noted that the supply spools 36*a*, 36*b* serve as the supply spool 25 shown in FIG. 1, and the takeup spools 36*c*, 36*d* serve as the takeup spool 26 shown in FIG. 1. Each of the supply spools 36*a*, 36*b* and the takeup spools 36*c*, 36*d* (hereinafter collectively referred to as "spools 36") is integrally formed by, for example, compound resin injection molding.

The ink ribbon 27 is formed from a broad-width resin film and has the ink surface on which the ink layer is formed. As shown in FIG. 2, the ink ribbon 27 is wound around the supply tube 40 and the takeup tube 41, which are made from paper.

Next, configuration of the spools 36 will be described.

Figure 3:
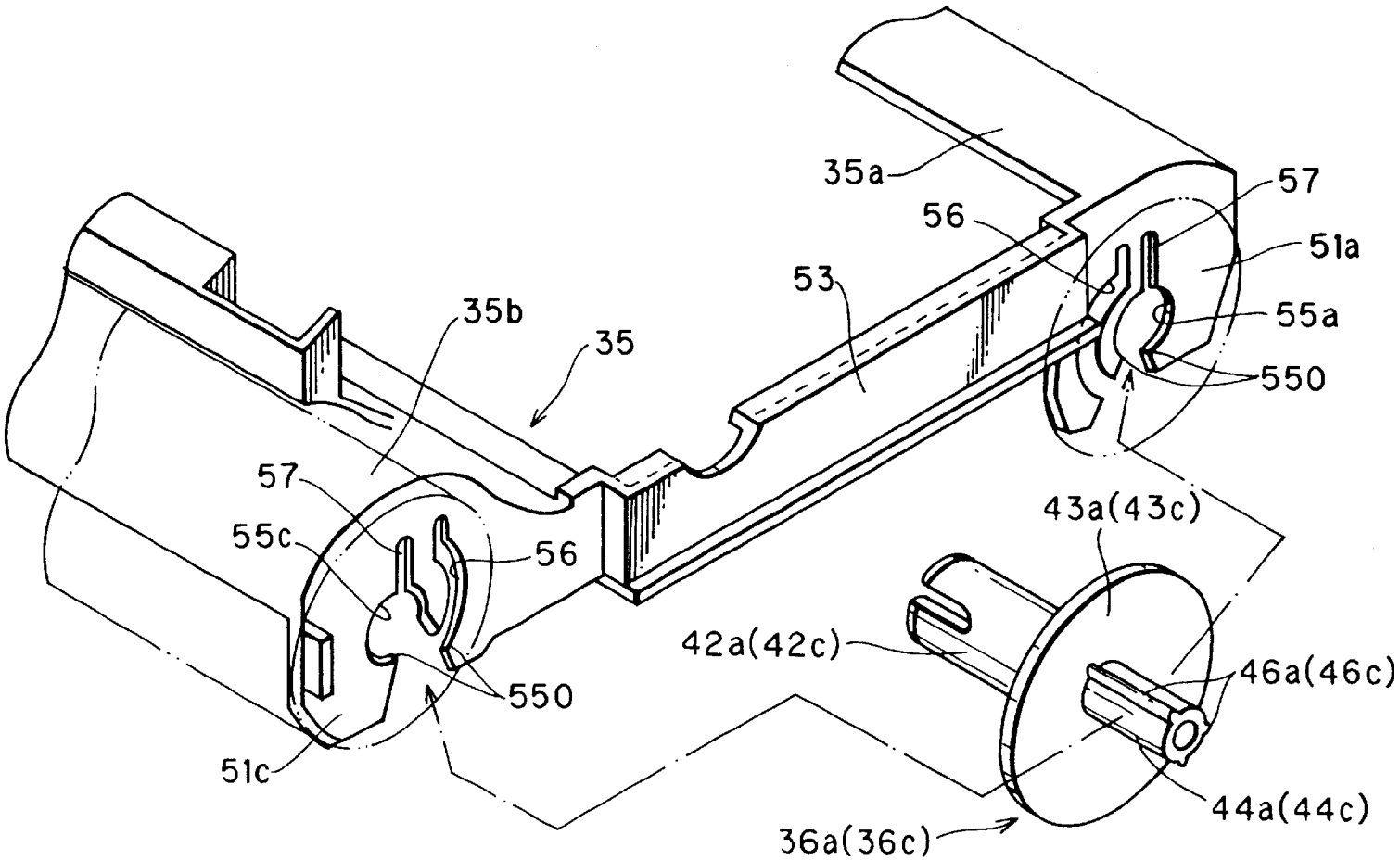
FIG. 3 is a partial perspective view of the ink ribbon cartridge of FIG. 2 with a portion removed to facilitate explanation.
Figure 4:
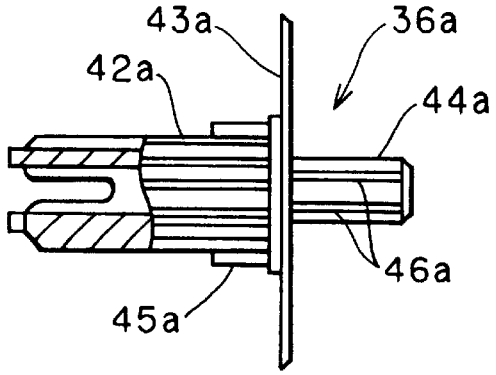
FIG. 4 is a side view in partial cross-section of a spool of the ribbon cartridge of FIG. 2.

First, the supply spool 36*a* will be descried. It should be noted that the supply spool 36*a* and the takeup spool 36*c* have the same configuration, a description for the takeup spool 36*c* will be omitted. As shown in FIGS. 3 and 4, the supply spool 36*a* has a cylindrical inner shaft 42*a*, a flange 43*a*, and a cylindrical supporting shaft 44*a*. The flange 43*a* has a diameter greater than a diameter of the supporting shaft 44*a*. The inner shaft 42*a* is detachably fitted in the right end of the supply tube 40, and is formed with engagement protrusions 45*a*adjacent to the flange 43*a*. The engagement protrusions 45*a* are for fitting in engagement grooves (not shown) formed to the supply tube 40 so that the inner shaft 42*a* will not rotate with respect to the supply tube 40.

The supporting shaft 44*a* is formed with a plurality of protruding ribs 46*a* at its outer peripheral surface. The protruding ribs 46*a* are separated by an appropriate distance from one another in a circumferential direction of the supporting shaft 44*a*. The protruding ribs 46*a* are provided for preventing the shaft 36*a* from idly rotating around the axis of the supporting shaft 44*a*.

The takeup spool 36*c* has a cylindrical inner shaft 42*c*, a flange 43*c*, and a cylindrical supporting shaft 44*c*. The flange 43*c* has a diameter greater than a diameter of the supporting shaft 44*c*. The inner shaft 42*c* is detachably fitted in the right end of the takeup tube 41, and is formed with engagement protrusions 45*c* adjacent to the flange 43*c*. The engagement protrusions 45*c* are for fitting in engagement grooves (not shown) formed to the takeup tube 41 so that the inner shaft 42*c* will not rotate with respect to the takeup tube 41.

Figure 5:
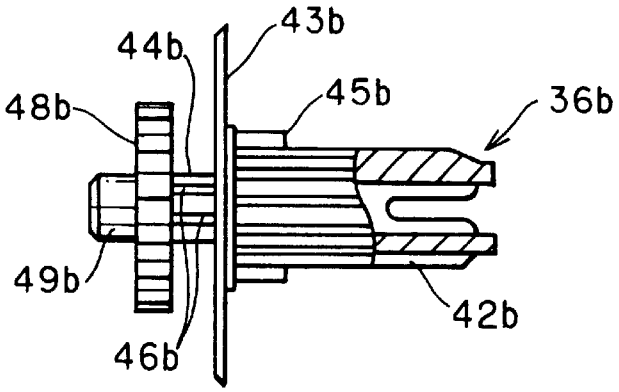
FIG. 5 is a side view in partial cross-section of another spool of the ink ribbon cartridge of FIG. 2.
Figure 7:
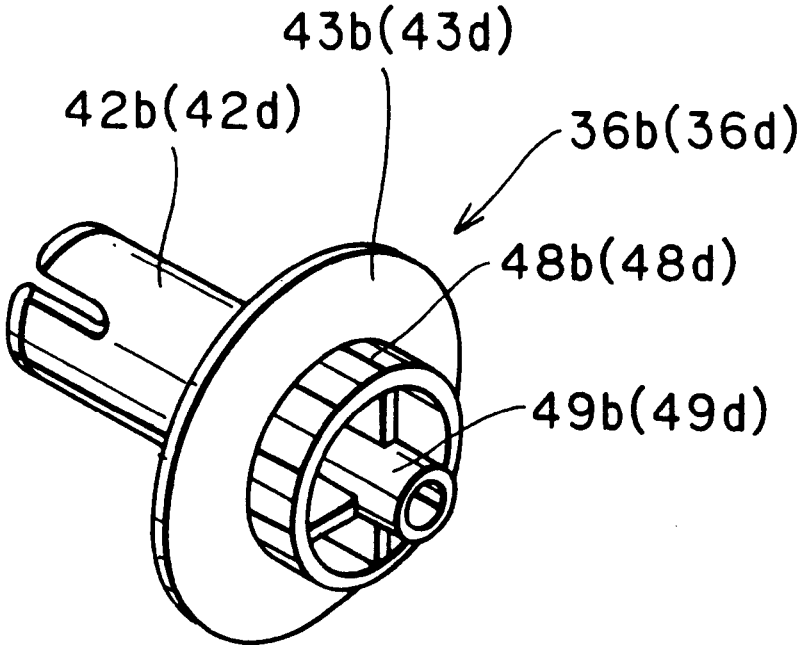
FIG. 7 is a perspective view of the spools shown in FIGS. 5 and 6.

Next, the supply spool 36*b* will be described. As shown in FIGS. 5 and 7, the supply spool 36*b* has a cylindrical inner shaft 42*b* for fitting in the left end of the supply tube body 40, a flange 43*b*, a cylindrical supporting shaft 44*b*, a gear 48*b*, a supporting shaft 44*b*, and an outer shaft 49*b*. The flange 43*b* has a diameter greater than the diameter of the supporting shaft 44*b*. The gear 48*b* is provided outside of the flange 43*b*.

The inner shaft 42*b* is formed with engagement protrusions 45*b* adjacent to the flange 43*b*. The engagement protrusions 45*b* are provided in a predetermined arrangement for fitting into grooves (not shown) formed to the left end of the supply tube 40. A plurality of protruding ribs 46*b* are formed to an outer peripheral surface of the supporting shaft 44*b* so as to be separated by an appropriate distance in the circumferential direction of the supporting shaft 44*b*. It should be noted that the configuration and the dimensions of the inner shaft 42*b* and the flange 43*b* are the same as those of the inner shaft 42*a* and the flange 43*a* of the supply spool 36*a*.

Figure 6:
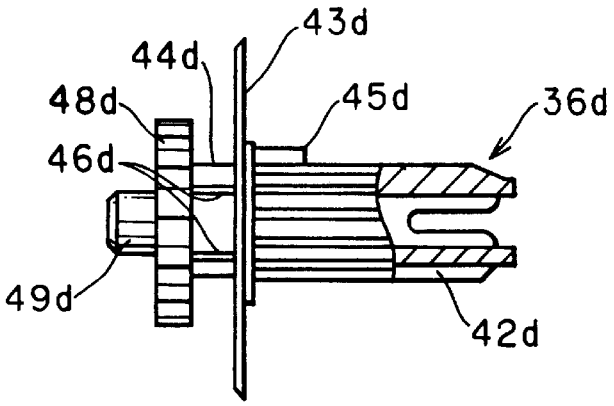
FIG. 6 is a side view in partial cross-section of still another spool of the ink ribbon cartridge of FIG. 2.

Next, the takeup spool 36*d* will be described. As shown in FIGS. 6 and 7, the takeup spool 36*d* has a configuration and dimensions similar to those of the supply spool 36*b*. That is, the takeup supply spool 36*d* has a cylindrical inner shaft 42*d*for fitting in the left end of the takeup tube body 41, a flange 43*d*, a cylindrical supporting shaft 44*d*, a gear 48*d*, a supporting shaft 44*d*, and an outer shaft 49*d*. However, as shown in FIG. 6, a supporting shaft 44*d* has a diameter greater than a diameter of the supporting shaft 44*b* of the supply spool 36*b*. Also, although not shown in the drawings, engagement protrusions 45*d* formed to the inner shaft 42*d* have an arrangement different from that of the engagement protrusions 45*b*. That is, because the engagement protrusions 45*a* , 45*b*, 45*c* are formed in the same arrangement, the engagement protrusions 45*d* are formed in the arrangement different from that of all the engagement protrusions 45*a*, 45*b*, 45*c*.

As described above, each end of the supply tube 40 and the takeup tube 41 is formed with the grooves (not shown) for engaging with the engagement protrusions 45 of the corresponding spool 36. Grooves are formed at the left end to the takeup tube 41 with an arrangement that different from the arrangement of the grooves at the right and left ends of the supply tube 40 and at the right end of the takeup tube 41.

With these configuration, the takeup spool 36*d* can be engaged with the left end of the takeup tube 41. In this way, the position where the takeup spool 36*d* is mounted is restricted.

Next, an explanation for configuration of the cartridge case 35 will be provided while referring to FIGS. 2, 3. The cartridge case 35 includes a supply-side upper cover 35*a*, a takeup-side upper cover 35*b*, a pair of connection ribs 52, 53, and side plates 51*a*, 51*b*, 51*c*, 51*d* (hereinafter referred to collectively as "side plates 51"). All of these components are integrally formed by, for example, compound resin injection molding. The supply-side upper cover 35*a* and the takeup-side upper cover 35*b* are elongated in the left and right directions. The connection rib 52 connects the left end of the supply-side upper cover 35*a* to the left end of the takeup-side upper cover 35*b*. Similarly, the connection rib 53 connects the right end of the supply-side upper cover 35*a* to the right end of the takeup-side upper cover 35*b*. As a result, the connection ribs 52, 53, the supply-side upper cover 35*a*, and the takeup-side upper cover 35*d* define a window portion 54. When the ink ribbon cartridge 24 is mounted to the facsimile machine 1, a portion of the ink ribbon 27 extending between the supply tube 40 and the takeup tube 41 is exposed through the window portion 54 to the platen 20 above and the thermal head 22, the tension body 28, and the print mount 23 below.

Figure 8A:
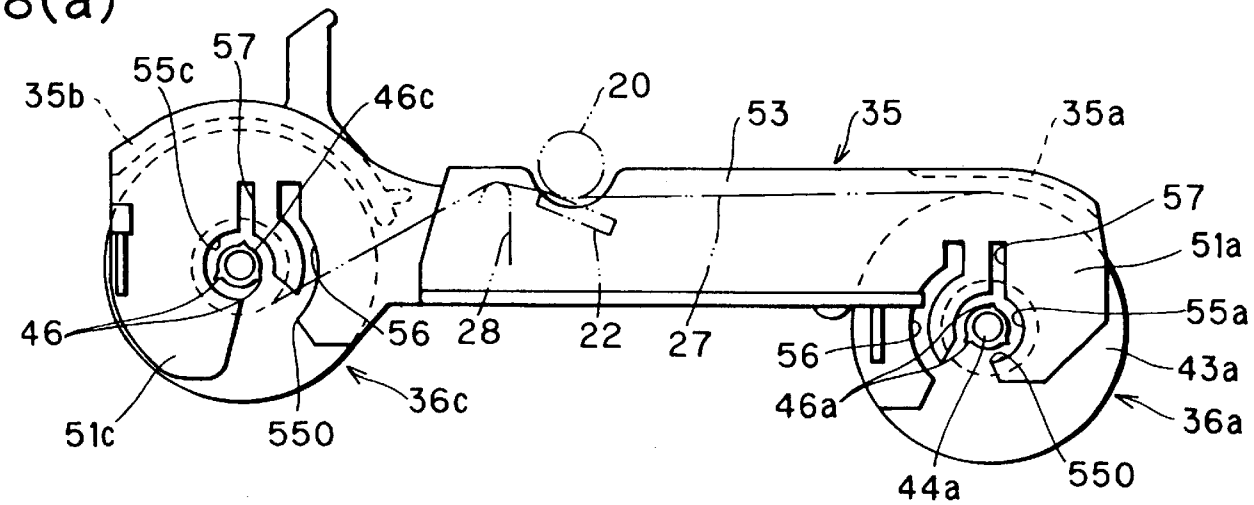
FIG. 8(*a*) is a right side view of the ink ribbon cartridge.
Figure 8B:
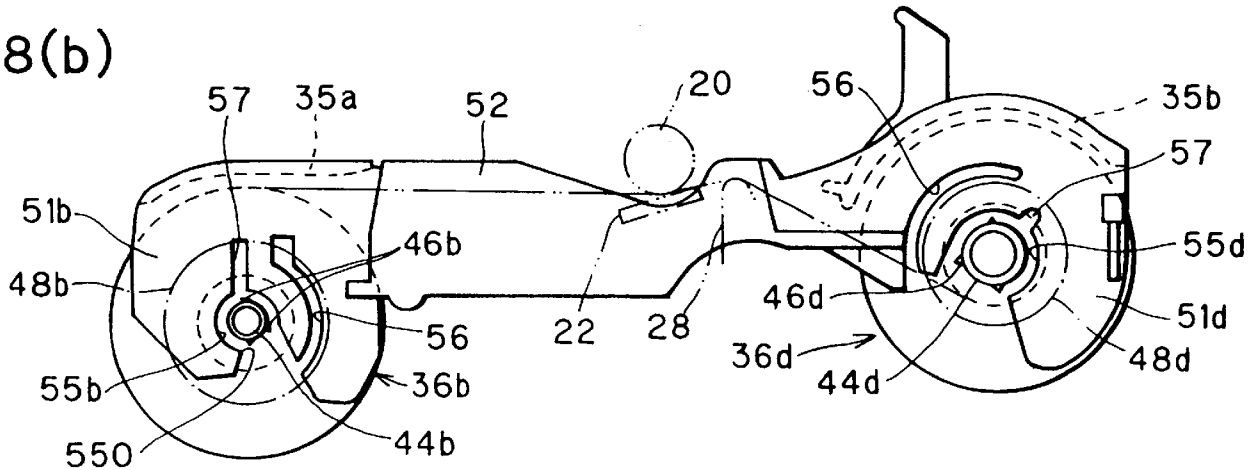

As shown in FIGS. 3, 8(*a*), 8(*b*), the side plates 51 are deposed where the connection ribs 52, 53 connect to the supply-side upper cover 35*a*and the takeup-side upper cover 35*b*. The side plates 51 are formed with support openings 55*a*, 55*b*, 55*c*, 55*d* (hereinafter referred to as "support openings 55"), respectively. The supporting shaft 44*a* to 44*d* are freely rotatably mounted into corresponding ones of the support openings 55. Each of the support openings 55 is formed with a downward opening cutout portion defined by edges 550, and is also formed with a resilient grooves 56, 57. The resilient grooves 56 are formed external to the openings 55 in a curved shape that substantially follows the contour of the support openings 55. The resilient grooves 57 extend radially form the support openings 55. The support opening 55*d* has a diameter greater than diameter of the other support openings 55*a*, 55*b*, 55*c*.

In order to mount spools 36, mounted with the ink ribbon 27, into the cartridge case 35, the supporting shafts 44 of the spools 36 are pressed upward into the corresponding support openings 55. At this time, the edges 550 of the support openings 55 resiliently bend to allow the supporting shafts 44 through the downward facing cutout portions into the support openings 55. However, the supporting shafts 44 will not fall out from the support openings 55 once inserted because the width dimension of the cutout portions are smaller than the diameter of corresponding supporting shafts 44. It should be noted that the large diameter supporting portion 44*d* of the takeup spool 36*d* can only fit in the large support opening 55*d* of the side plate 51*d*. Therefore, the position where the takeup spool 36*d* is attached to the cartridge case 35 is restricted to the large support opening 55*d*.

When the ink ribbon cartridge 24 is mounted in the facsimile machine 1, the pair of the connection ribs 52, 53 of the cartridge case 35 are supported in a predetermined posture. At this time, the outer shafts 49*b*, 49*d* of the takeup spool 36*d* and the takeup spool 36*d* are engaged with protrusions formed on a main frame (not shown) of the facsimile machine 1. Also, the gears 48*b*, 48*d* are brought into meshing engagement with drive force transmission gears (not shown). Further, the supporting shafts 44*a*, 44*c* of the supply spool 36*a* and the takeup spool 36*c* are engaged in protrusions the resiliently protrude from the main frame (not shown).

As a result, as shown in FIG. 8(*a*), the supporting shafts 44*a*, 44*c* of the spools 36*a*, 36*c* are arranged in substantial concentric condition with the support openings 55*a*, 55*c* of the side plates 51*a*, 51*c*. At this time, all of the protruding ribs 46*a*, 46*c* on the supporting shafts 44*a*, 44*c* are arranged so as not to contact the inner peripheral surface defining the support openings 44*a*, 55*c*. Also, as shown in FIG. 8(*b*), the supporting shafts 44*b*, 44*d* of the spools 36*b*, 36*d* are arranged in substantial concentric condition with the support openings 55*b*, 55*d* of the side plates 51*b*, 51*d*. All of the protruding ribs 46*b*, 46*d* formed on the supporting shafts 44*b*, 44*d* are arranged so as not to contact the inner peripheral surface defining the support openings 55*b*, 55*d*. Therefore, the ribbon supply spool 25 and the ribbon takeup spool 26 can smoothly rotate.

Figures 9A, 9B:
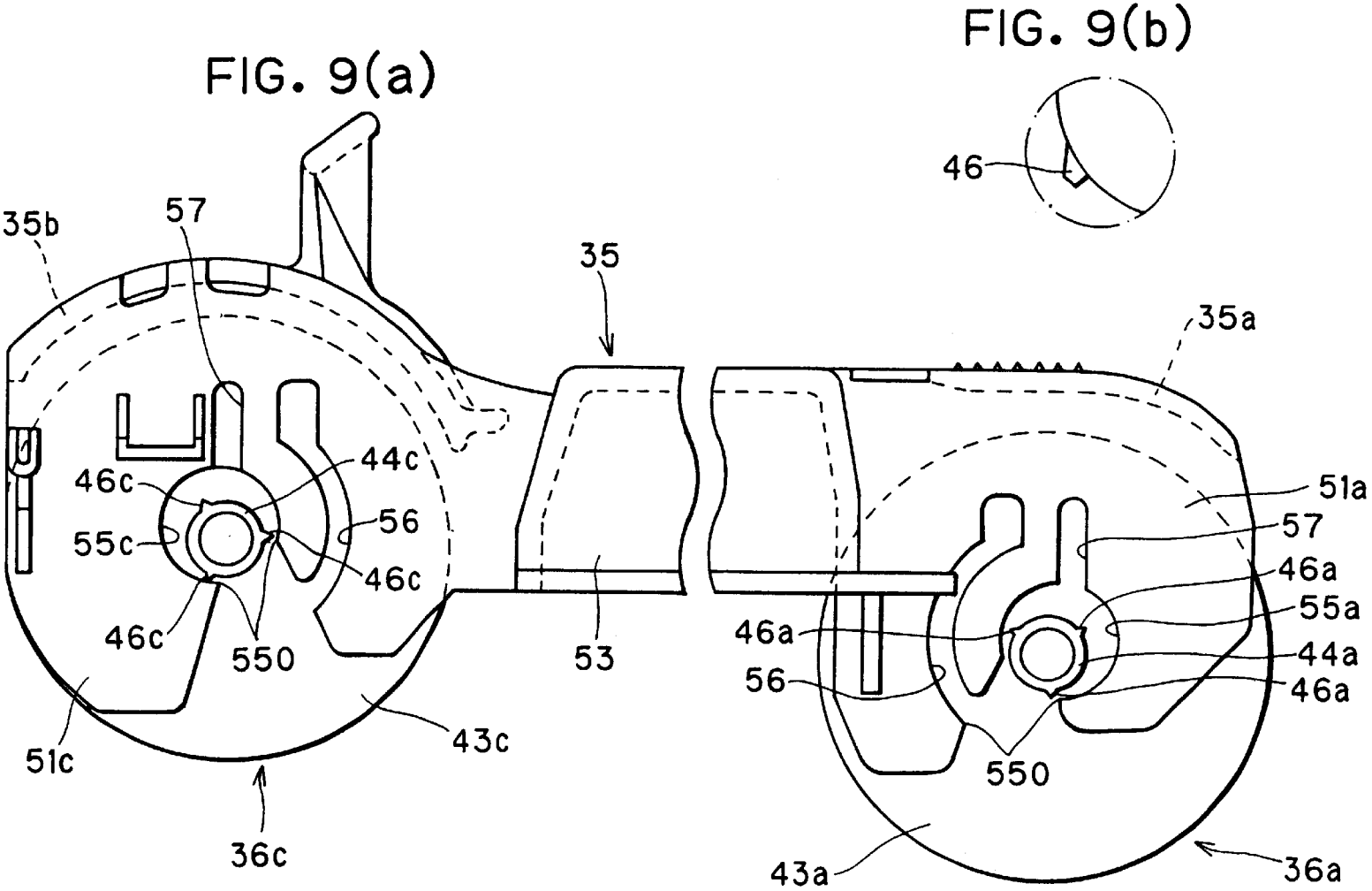
FIG. 9(*a*) is a partial right side view of the ink ribbon cartridge in a lifted up condition.

On the other hand, when the operator lifts up the cartridge case 35 when replacing the ink ribbon 27, then as shown in FIG. 9(*a*), the weight of the ink ribbon 27 and the like shifts the supporting shafts 44 down with respect to the cartridge case 35 into contact with the edges 550 of the support shaft openings 55. As a result, the protruding ribs 46 of the supporting shafts 44 catch on the edges 550, so that the spools 36, that is, the supply tube 40 and the takeup tube 41, are prevented from unintentionally rotating, and the ink ribbon 27 wound around the supply tube 40 and the takeup tube 41 is prevented from loosening.

Also, although not shown in the drawings, when the ink ribbon cartridge 24 is placed on a table (not shown), for example, with the supply-side upper cover 35*a* and the takeup-side upper cover 35*b* facing upward, the weight of the cartridge case 35 shifts the support openings 55 down with respect to the supporting shafts 44. As a result, the protruding ribs 46 of the supporting shafts 44 catch on the edges of the grooves 57, so that the spools 36 do not unintentionally rotate, and the ink ribbon 27 is prevented from loosening. It should be noted that even when the ink ribbon cartridge 24 is placed on the table upside down, the spools 36 are prevented from rotating in the same manner as when the ink ribbon cartridge 24 is lifted up. FIG. 9(*b*) shows an example of the protruding ribs 46.

Figure 10A:
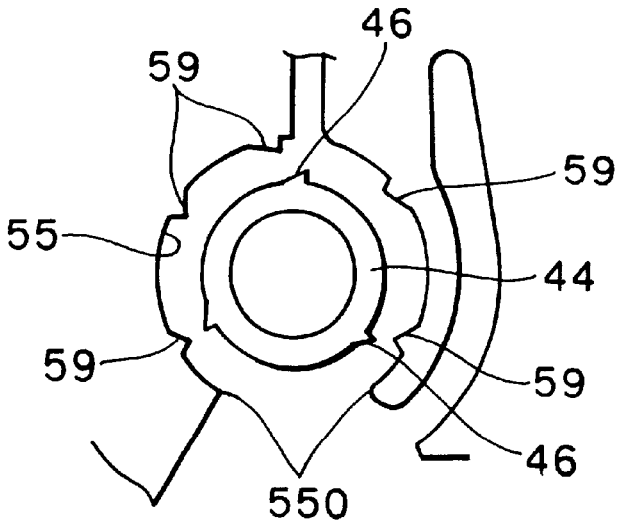
FIG. 10(*a*) is a side view showing a support opening and a support portion of an ink ribbon cartridge according to a second embodiment of the present invention.
Figure 10B:
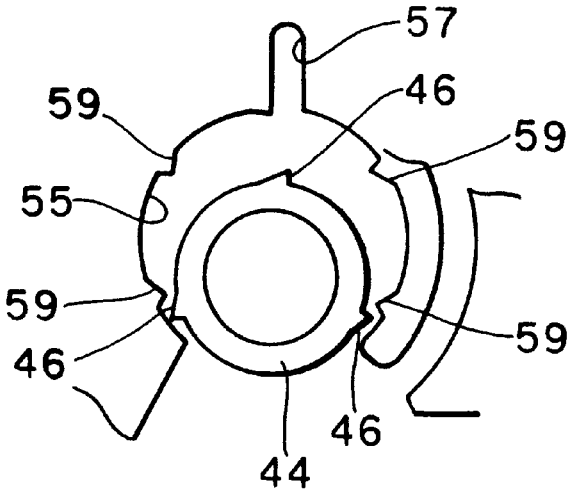

Next, an ink ribbon cartridge according to a second embodiment of the present invention will be described while referring to FIGS. 10(*a*), 10(*b*). The ink ribbon cartridge according to the second embodiment is similar to the ink ribbon cartridge 24 of the first embodiment, except that, as shown in FIGS. 10(*a*) and 10(*b*), one or a plurality of supplementary protrusions 59 are formed in an appropriate spacing on an inner peripheral surface defining the supporting openings 55. With this configuration, as shown in FIG. 10(*a*), when the ink ribbon cartridge is mounted in the facsimile machine 1, the supporting shafts 44 are arranged in concentric condition with the surface defining the support openings 55 in the same manner as in the first embodiment, and the protruding ribs 46 are arranged so as not to contact with the inner peripheral surface.

However, as shown in FIG. 10(*b*), when the ink ribbon cartridge is lifted up into the air or placed on a table, for example, the supporting shafts 44 shift into an eccentric condition with respect to the support openings 55 so that some of the protruding ribs 46 catch on the supplementary protrusions 59. In this way, the ink ribbon 27 is prevented from loosening.

In the above described first and second embodiments, the protruding ribs 46 are provided to all of the spools 36. However, the same operations and effects of the above-described embodiments can be achieved by providing protruding ribs 46 to only the supply or the takeup spools or to only left or right side spools. In these cases, the supplemental protrusions 59 can be provided to the corresponding support openings 55 if desired.

Also, according to the embodiments described above, when a spent ink ribbon replaced, the spools are removed from the tubes and attached to new ones. Therefore, the configuration is extremely economical.

Further, each spool can be fitted in and removed from a cartridge case of the ink ribbon cartridge by mounting and dismounting the spools into and from supporting openings through the cutout portions. Because there is no need to provide compression coil springs, the configuration of the ink ribbon cartridge is simplified, and operations for mounting and dismounting the spools are also simplified.

Also, by simply providing protrusion ribs around supporting portions of the spools, the spools can be prevented from rotating when the ink ribbon cartridge is taken out from the facsimile machine. Therefore, production costs of the ink ribbon cartridge can be reduced.

Next, an ink ribbon cartridge 124 according to a third embodiment of the present invention will be described while referring to FIGS. 11 to 18. It should be noted that the ink ribbon cartridge 124 is used in the facsimile machine 1 in the same manner as in the first embodiment described above.

Figure 11:
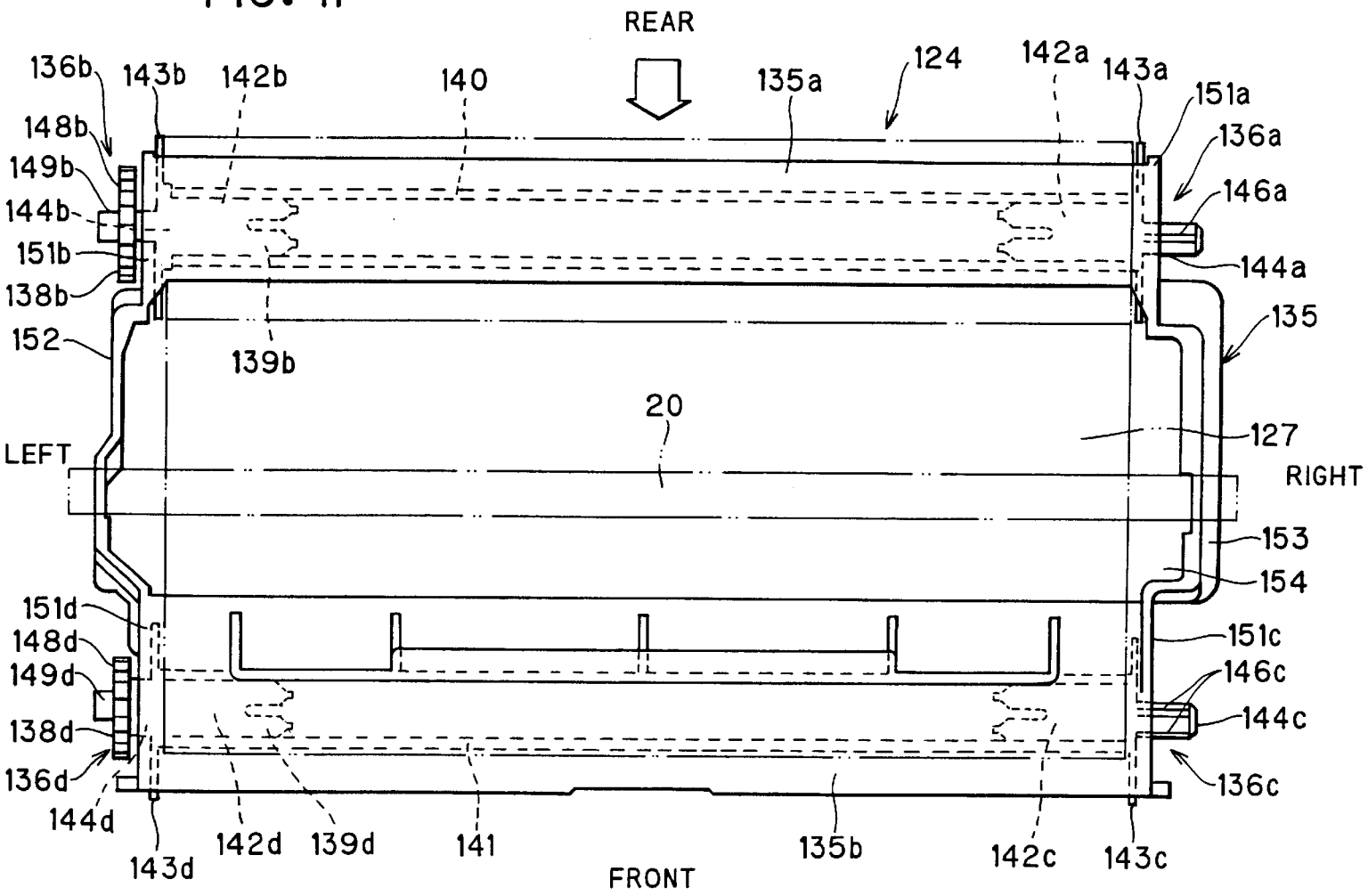
FIG. 11 is a plan view of an ink ribbon cartridge as viewed from the above according to the second embodiment of the present invention.
Figure 12:
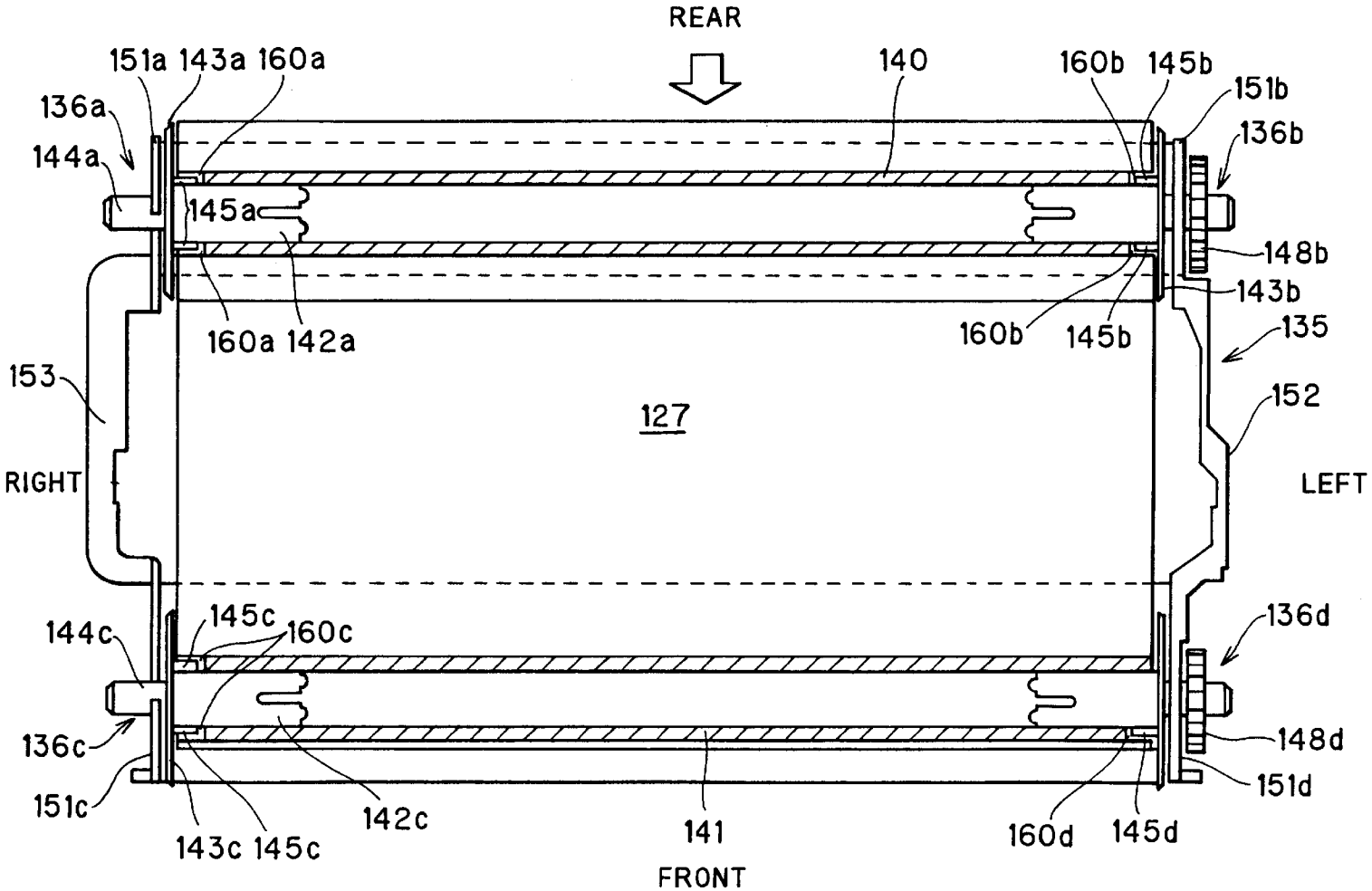
FIG. 12 is a plan view of the ink ribbon cartridge of FIG. 11 as viewed from below.

As shown in FIGS. 11 and 12, the ink ribbon cartridge 124 includes a cartridge case 135, an ink ribbon 127, a pair of right and left supply spools 136*a*, 136*b*, a pair of right and left takeup spools 136*c*, 136*d*, a cylindrical supply tube 140, and a cylindrical takeup tube 141. The supply spools 136*a*, 136*b* and the takeup spools 136*c*, 136*d* are collectively referred to as spools 136. Each of the tubes 140, 141 has right and left ends. The supply spools 136*a*, 136*b* are fitted into the right and left ends of the supply tube 140, respectively, and the takeup spools 136*c*, 136*d* are fitted into the right and left ends of the takeup tube 141, respectively. It should be noted that the supply spools 136*a*, 136*b* serve as the supply spool 25 shown in FIG. 1, and the takeup spools 136*c*, 136*d* serve as the takeup spool 26 shown in FIG. 1. Each of the spools 136 are formed by, for example, compound resin injection molding.

The ink ribbon 127 is the same as the ink ribbon 27 described in the first embodiment and is wound around the supply tube 140 and the takeup tube 141.

Figure 14A:
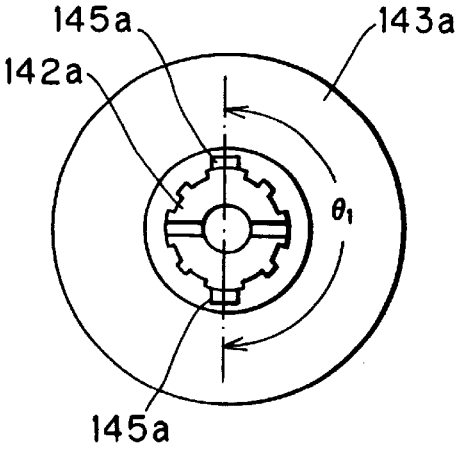
FIG. 14(*a*) is a side view of one spool of the ink ribbon cartridge shown in FIG. 11.
Figure 14B:
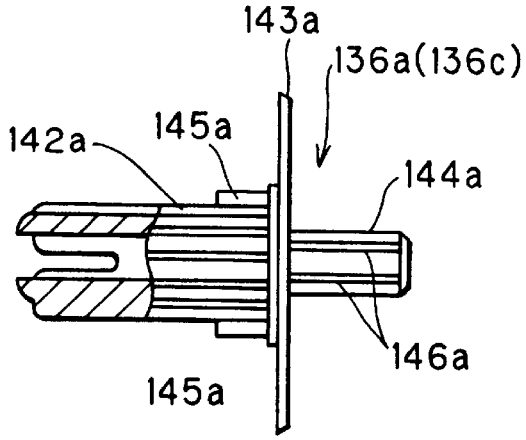

Next, the spools 136*a*, 136*c* will be described wile referring to FIGS. 14(*a*) and 14(*b*). It should be noted that because the supply spool 136*a* and the takeup spool 136*c* have the same configuration and dimensions, only the supply spool 136*a* will be described so as to avoid duplication in explanation. As shown in FIG. 14(*b*), the supply spool 136*a* has a cylindrical inner shaft 142*a*, a flange 143*a*, and a cylindrical supporting shaft 144*a*. The inner shaft 142*a* is for fitting in the right end of the supply tube 140, and is formed with a pair of engagement protrusions 145*a* adjacent to the flange 143*a*. As shown in FIG. 14(*b*), the engagement protrusions 145*a* are arranged at an angle θ1 of 180 degrees with respect to an axial center of the supporting shaft 144*a*. The supporting shaft 144*a* is firmed with a plurality of protruding ribs 146*a* at its outer peripheral surface. The protruding ribs 146*a* are separated by an appropriate distance from one another around the circumference of the supporting portion 144*a*. The takeup spool 136*c* has a cylindrical inner shaft 142*c*, a flange 143*c*, and a cylindrical supporting shaft 144*c*. The inner shaft 142*c* is for fitting in the right end of the takeup tube 141, and is formed with a pair of engagement protrusions 145*c* adjacent to the flange 143*c*. The engagement protrusions 145*c* are arranged at an angle θ1 of 180 degrees with respect to an axial center of the supporting shaft 144*c*. The supporting shaft 144*c* is formed with a plurality of protruding ribs 146*c* at its outer peripheral surface. The protruding ribs 146*c* are separated by an appropriate distance from one another around the circumference of the supporting portion 144*c*.

Next, the supply spool 136*b* will be described while referring to FIGS. 11, 12, and 15(*a*) to 16(*b*). As shown in FIG. 11, the supply spool 136*b* has a first portion 139*b* and a second portion 138*b* detachably engaged with the first portion 139*b*. As shown in FIG. 16(*a*) and 16(*b*), the first portion 139*b* is formed with an inner shaft 142*b*, a flange 143*b*, and a supporting shaft 144*b*. As shown in FIG. 12, the inner shaft 142*b* is formed with a pair of engagement protrusions 145*b* and a pair of attachment holes 163*b* adjacent to the flange 143*b*. The engagement protrusions 145*b* are arranged at an angle of 180 degrees with respect to an axial center of the inner shaft 142*b*. The attachment holes 163*b* are penetrating the inner shaft 142*b* in its radial direction.

Figure 15A:
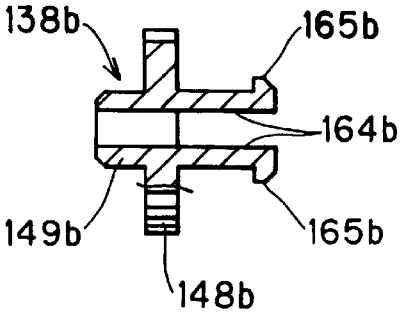
FIG. 15(*a*) is a plan view of a portion of another spool of the ink ribbon cartridge shown in FIG. 11.
Figure 15B:
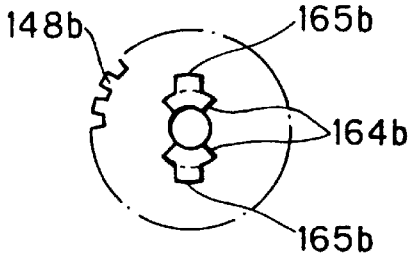
Figure 16A:
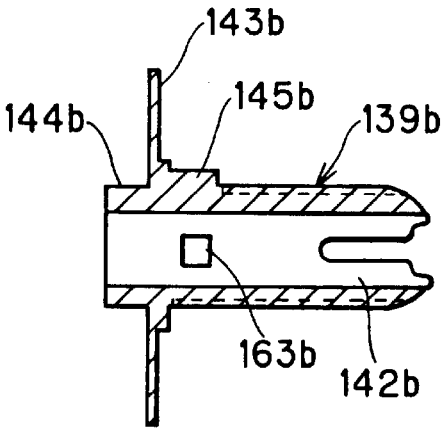
FIG. 16(*a*) is a plan view of another portion of the another spool of FIG. 15(*a*)
Figure 16B:
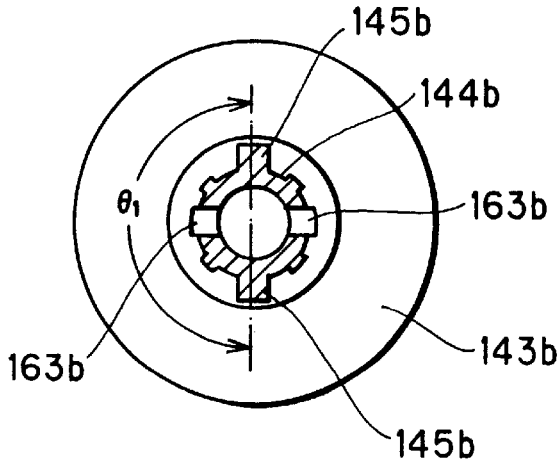

As shown in FIGS. 15(*a*) and 15(*b*), the second portion 138*b* has a gear 148*b*, an outer shaft 149*b*, and a pair of arms 165*b*. Each of the arms 164*b* is formed with an engagement portion 165*b* extending radially outward from the corresponding arm 164*b*. The engagement portions 165*b* are engageable in the attachment holes 163*b* formed in the inner shaft 142*b*.

According to this configuration, when the arms 164*b* are inserted into the support shaft 144*b* against the resilient force of the arms 164*b*, the engagement portions 165*b* engage in the attachment holes 163*b*, thereby preventing the outer shaft 144*b* from unintentionally separating from the inner shaft 142*b*.

Figure 13A:
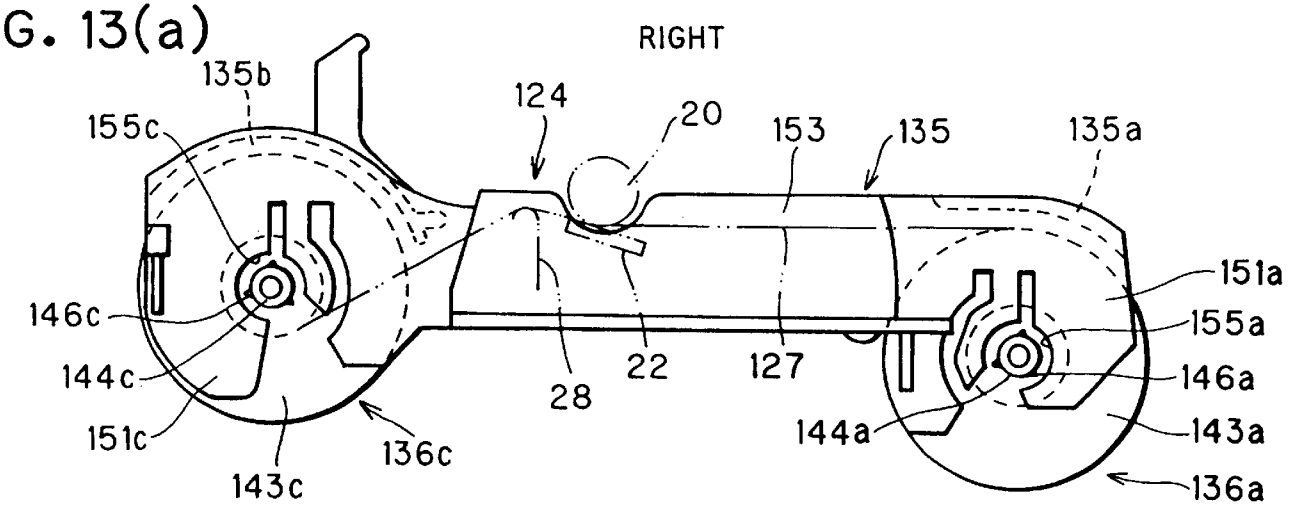
FIG. 13(*a*) is a right side view of an ink ribbon cartridge of FIG. 11.
Figure 13B:
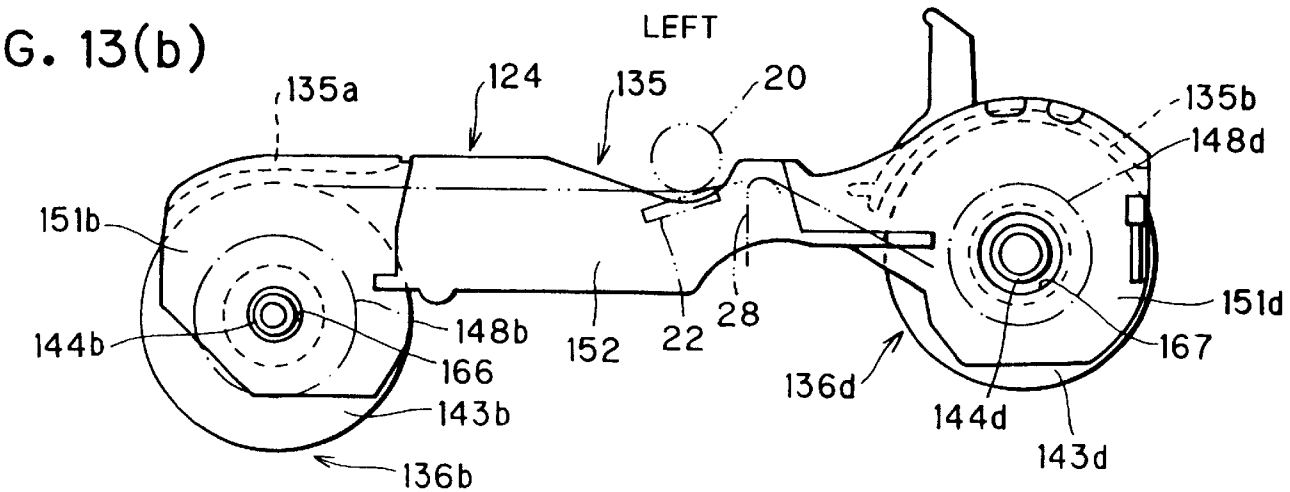
Figure 17:
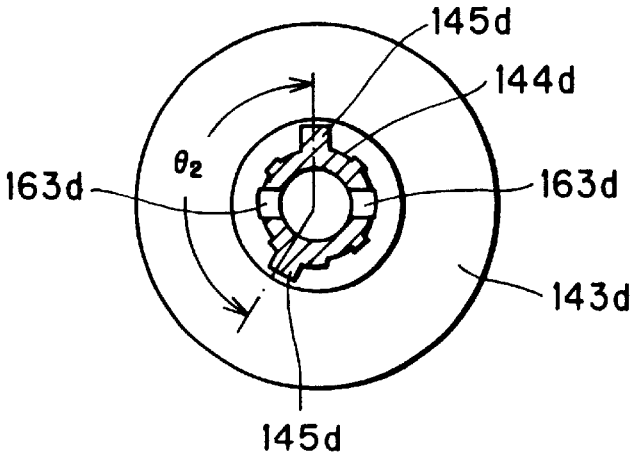
FIG. 17 is a plan view of still another spool of the ink ribbon cartridge shown in FIG. 11.

Next, the takeup spool 136*d* will be described. The takeup spool 136*d* has a configuration and dimensions similar to those of the supply spool 136*b*. That is, the takeup spool 136*d* has a first portion 139*d* and a second portion 138*d* detachably engaged with the first portion 139*d*. However, as shown in FIGS. 11 and 13(*b*), a supporting shaft 144*d* of the takeup spool 136*d* has a diameter greater than a diameter of the supporting shaft 144*b* of the supply spool 136*b*. Also, positions where engagement protrusions 145*d* in the takeup spool 136*d* are formed differ from that in the supply spool 136*b*. Specifically, as shown in FIG. 17, the engagement protrusions 145*d* are arranged at an angle θ2 of 120 degrees with respect to an axial center of a support shaft 144*d*.

Next, the supply tube 140 and the takeup tube 141 will be described. As shown in FIG. 12, the supply tube 140 is formed with a pair of grooves 160*a* in its right end and a pair of grooves 160*b* in its left end. Similarly, the takeup tube 141 is formed with a pair of grooves 160*c* in its right end and a pair of grooves 160*d* in its left end. Each pair of the grooves 160*a* to 160*d* are for engaging with the corresponding engagement protrusions 145*a* to 145*d* of the spools 136. Although not shown in the drawings, the grooves 160*d* at the left end of the takeup tube 141 are arranged at an angle of 120 degrees with respect to an axial center of the takeup tube 141. On the other hand, each pair of the other grooves 160*a* to 160*c* are arranged at an angle of 180 degrees with respect to an axial center of the corresponding tube 140, 141.

With this configuration, the takeup spool 136*d* can only be mounted in the let end of the takeup tube 141. In this way, the position where the takeup spool 136*d* can be attached is restricted. On the other hand, the spools 136*a* to 136*c* are arranged at the same angle θ1, and so can fit into any end of the tubes 140, 141, with the exception of the left end of the takeup tube 141.

Next, an explanation for configuration of the cartridge case 135 according to the third embodiment will be provided while referring to FIGS. 11 to 13(*b*). As shown in FIGS. 11 and 12, the cartridge case 135 includes a supply-side upper cover 135*a,* a takeup-side upper cover 135*b,* a pair of connection ribs 152, 153, and four side plates 151*a,* 151*b,* 151*c,* 151*d.* All of these components are formed integrally by, for example, compound resin injection molding. The supply-side upper cover 135*a* and the takeup-side upper cover 135*b* are elongated in the left and right directions. The connection rib 152 connects the left end of the supply-side upper cover 135*a* to the left end of the takeup-side upper cover 135*b.* Similarly, the connection rib 153 connects the right end of the supply-side upper cover 135*a* to the right end of the takeup-side upper cover 135*b.* As a result, the connection ribs 152, 153, the supply-side upper cover 135*a,* and the takeup-side upper cover 135*b* define a window portion 154.

The side plates 151*a* to 151*d* are disposed where the connection ribs 152, 153 connect the supply-side upper cover 135*a* and the takeup-side upper cover 135*b.* As shown in FIG. 13(*a*), the side plates 151*a,* 151*c* are formed with support openings 155*a,* 155*c,* respectively. Since the side plates 151*a* and 151*c* have the same configuration as the side plates 51*a* and 51*c* of the first embodiment, detailed description will be omitted.

On the other hand, as shown in FIG. 13(*b*), the side plates 151*a,* 151*d* are formed with circular holes 166, 167, respectively. The circular hole 167 has a diameter greater than a diameter of the circular hole 166. The circular hole 167 is capable of freely fitting the support shaft 144*d* of the takeup spool 136*d.* The circular hole 166 is capable of freely fitting the support shaft 144*b* of the supply spool 136*b,* but not the support shaft 144*d* of the takeup spool 136*d.*

Next, operations for attaching the spools 136*b,* 136*d* to the cartridge case 135 will be described. First, the support shaft 144*d* of the takeup spool 136*d* is fitted into the circular hole 167 from the inner side of the side plate 151*d* so as to protrude outward through the circular hole 167. Then, the arm 164*d* of the outer shaft 149*d* is inserted into the supporting shaft 144*d* from outside of the side plate 151*d* so that the side plate 151*d* is sandwiched between the flange 143*d* and the gear 148*d.* At this time, the engagement portions 165*d* at the front tip of the arm 164*d* engage into the attachment holes 163*d* of the inner shaft 142*d.* In this way, the takeup spool 136*d* is prevented from unintentionally separating from the cartridge case 135. Then, the supply spool 136*b* is attached to the side plate 151*b* in the same manner as the takeup spool 136*d* described above. Because, as described above, the takeup spool 136*d* has the large diameter support shaft 144*d,* the takeup spool 136*d* can only be mounted in the circular hole 167. Therefore, the position where the spool 136*d* is mounted is restricted with respect to the cartridge case 138.

Figure 18:
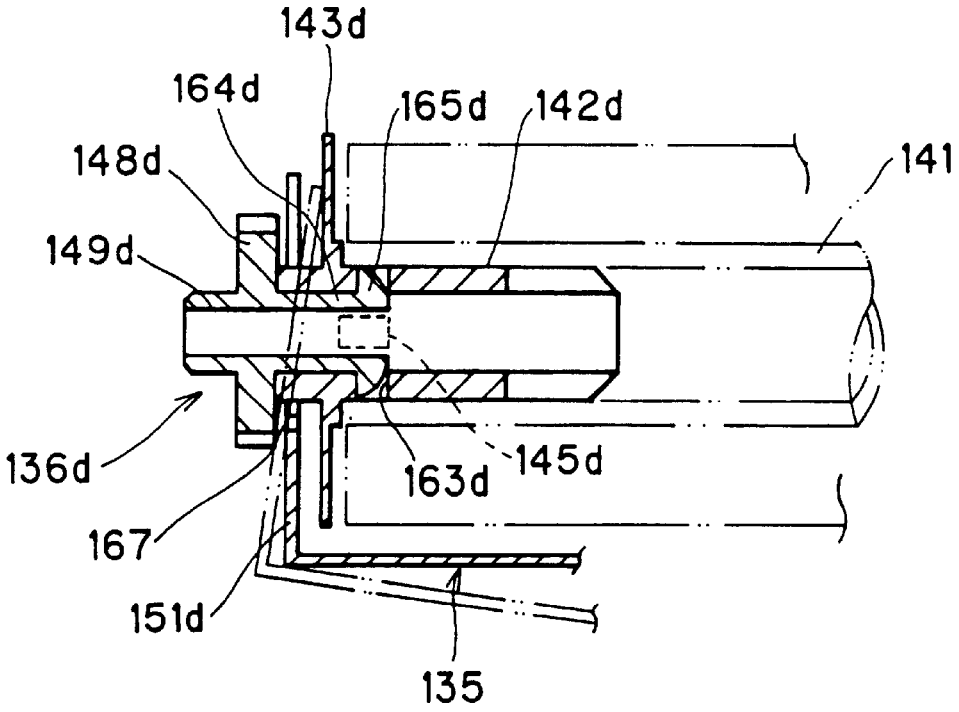
FIG. 18 is across-sectional view showing the spool of FIG. 17 attached to a cartridge case of the ink ribbon cartridge.
Figure 19:
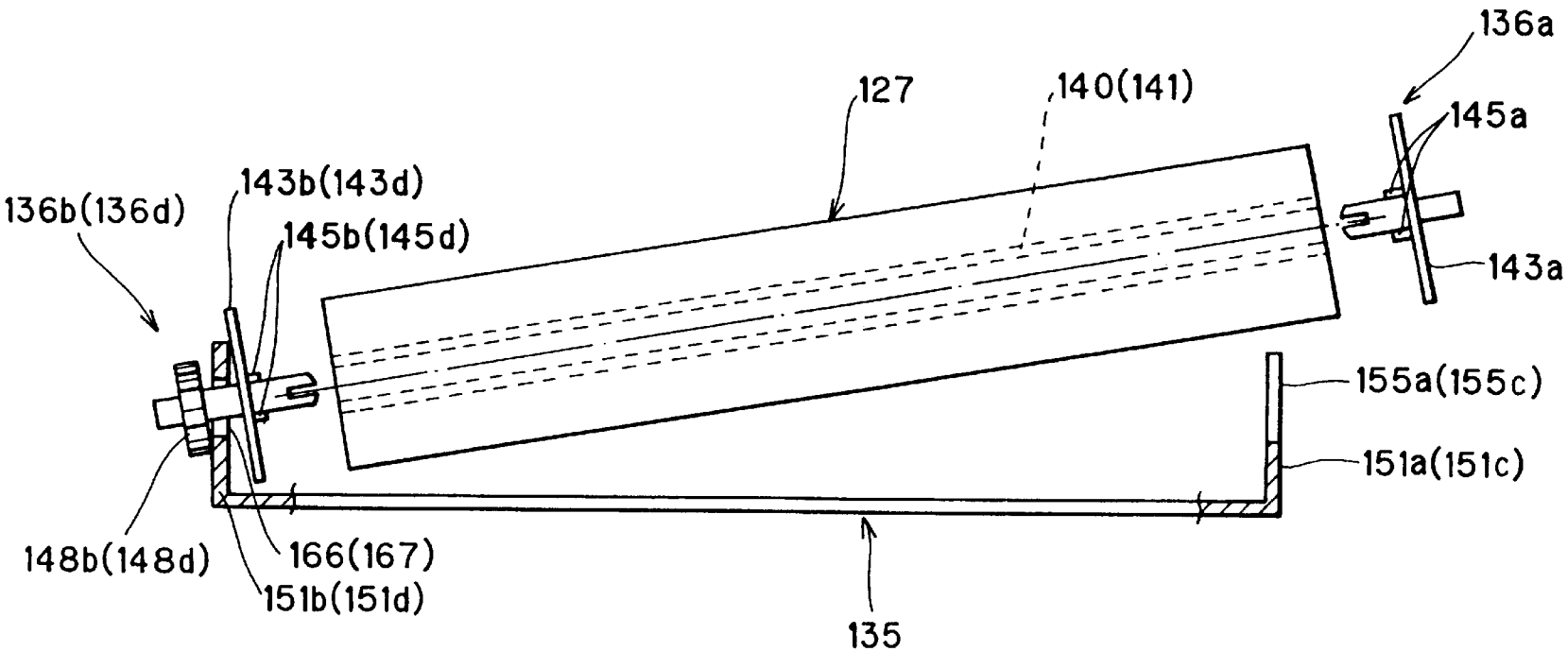
FIG. 19 is side view showing operations for mounting an ink ribbon into the cartridge case of the ink ribbon cartridge according to a third embodiment of the present invention.

The diameter of the support shaft 144*b* is smaller than the diameter of the circular hole 166, and the diameter of the support shaft 144*d* is smaller than the diameter of the circular hole 167. Therefore, as shown in FIGS. 18 and 19, axial lines of the spools 136*b,* 136*d* can be oriented at a slant with respect to the corresponding side plate 151*b,* 151*d.* This configuration is advantageous for reasons to be described later.

Next, operations for mounting the ink ribbon 127 to the cartridge case 135 will be described. First, as shown ion FIG. 19, the cartridge case 135 with the spools 136*d,* 136*b* attached thereto is turned upside down, that is, with the upper covers 135*a,* 135*b* facing downward. Then, the left ends of the supply tube 140 and the takeup tube 141 are engaged with the spools 136*b,* 136*d,* respectively. At this time, since the axial lines of the spools 136*b,* 136*d* can be oriented at a slant with respect to the corresponding side plate 151*b,* 151*d,* the supply tube 140 and the takeup tube 141 can be mounted without removing the spools 136*b,* 136*d* from the cartridge case 135, and moreover without the ink ribbon 127 bumping against the cartridge case 135. Also, since the left end of the takeup tube 141 can be engaged only with the takeup spool 136*d,* the ink ribbon 127 can be mounted only with a specific orientation to the cartridge case 135, that is, without mistaking the upper and lower surfaces and right and left sides of the ink ribbon 127.

Next, the spools 136*a* and 136*c* are mounted in the right sides of the supply tube 140 and the takeup tube 141. It should be noted that because the supply spool 136*a* and the takeup spool 136*c* have the same configuration, the spools 136*a,* 136*c* can be attached to the right end of either the supply tube 140 or the takeup tube 141. Afterwards, the supporting shafts 144*a,* 144*c* of the spools 136*a,* 136*c* are inserted into the corresponding support openings 155*a,* 155*c.* As a result, the axial lines of the tubes 140, 141 are oriented perpendicular with respect to the side plates 151*a,* 151*c.* Also, in the same manner as in the first embodiment described above, the supporting shafts 144*a,* 144*c* protruding from the right side of the cartridge case 135 are arranged substantially concentric with the inner peripheral surface of the support openings 155*a,* 155*c* thereby preventing the protruding ribs 146*a,* 146*c* from contacting with the inner peripheral surfaces defining the support openings 155*a,* 155*c.*

When the ink ribbon cartridge 124 is dismounted from the facsimile machine 1, the protruding ribs 146*a,* 146*c* of the spool 136*a,* 136*c* prevent the spools 136*a,* 136*c,* that is, the supply tube 140 and the takeup tube 141, from rotating in the same manner in the above-described first embodiment. As a result, the ink ribbon 127 wound around the supply tube 140 and the takeup tube 141 will not loosen.

According to the third embodiment described above, the operations for exchanging the ink ribbon 127 can be performed without dismounting the spools 136*b,* 136*d* from the cartridge case 135. Therefore, it is unnecessary for an operator to test to find out the correct combination of spools 136 and side plates 151 each time operations for exchanging the ink ribbon 127 are performed. Therefore, the operations for exchanging the ink ribbon 127 can be quickly performed.

While the invention has been described in detail with reference to specific embodiments thereof, it would be apparent to those skilled in the art that various changes and modifications may be made therein without departing from the spirit of the invention, the scope of which is defined by the attached claims.

For example, the ink ribbon cartridge according to the present invention is used in a facsimile machine in the above-described embodiments. However, the ink ribbon cartridge of the present invention can be used in a printer, a copy machine, or a machine provided with a plurality of these functions.

Also, instead of or in addition to the above-described configurations, a portion or all of the side plate 51*d* (151*d*) can be colored in one color, for example, red, and a portion or all of the corresponding takeup spools 36*d* (136*d*) can be colored in the same color, that is, red, as the side plate 51*d* (151*d*). Also, portions or all of the other three spools 36*a* to 36*c* (136*a* to 136*d*) can be colored in a different color, such as green, instead of red. Moreover, the left end of the takeup body 41 (141) can be colored in the first color (red). With this configuration, the operator can mount the ink ribbon with the correct orientation, that is, with the upper side facing up and right and left side facing right and left into the cartridge case 35 (135) by arranging the same colored portions with extreme ease. In addition to this, the side plates of the cartridge case can also be colored in a different color so that the operator can recognize the right and left sides of the cartridge case 35 (135).

What is claimed is:

1. An ink ribbon cartridge comprising:

a body unit; and a ribbon unit detachably mounted on the body unit;

wherein the body unit includes a case having a first plate and a second plate facing the first plate, the first plate being formed with a first opening and a second opening each with a cutout portion, the second plate being formed with a third opening and a fourth opening;

a first spool detachably rotatably mounted in the first opening;

a second spool detachably rotatably mounted in the second opening;

a third spool rotatably mounted in the third opening; and a fourth spool rotatably mounted in the fourth opening, wherein at least one of the third spool and fourth spool is mounted in an undetachable fashion in the corresponding at least one of the third opening and the fourth opening; and the ribbon unit includes a first tube having a first end and a second end opposite from the first end, the first end being detachably engaged with the first spool, the second end being detachably engaged with the third spool;

a second tube having a third end and a fourth end opposite from the third end, the third end being detachably engaged with the second spool, the fourth end being detachably engaged with the fourth spool; and an ink ribbon would around the first tube and the second tube;

wherein the ribbon unit is detached from the body unit while the at least one of the third spool and the fourth spool is mounted in the corresponding at least one of the third opening and the fourth opening.

2. The ink ribbon cartridge according to claim 1, wherein each of the first end, the second end, the third end, and the fourth end is formed with a pair of grooves, the grooves of the fourth end being arranged at a different angle from the first end, the second end, and the third end, with respect to an axial center of the second tube; and each of the first spool, the second spool, the third spool, and the fourth spool is formed with a pair of protrusions engageable with the corresponding pair of the grooves, the protrusions of the fourth spool being arranged at a different angle from the first spool, the second spool, and the third spool, with respect to an axial center of the fourth spool.

3. The ink ribbon cartridge according to claim 1, wherein each of the third spool and the fourth spool includes an inner portion disposed in an inner side of the case and an outer portion disposed in an outer side of the case, each of the third spool and the fourth spool having a gear provided to the outer portion.

4. The ink ribbon cartridge according to claim 1, wherein each of the first spool, the second spool, the third spool, and the fourth spool includes a supporting shaft at which each of the first spool, the second spool, the third spool, and the fourth spool is supported in the corresponding first opening, second opening, third opening, and fourth opening, respectively, the supporting shaft of the fourth spool having a diameter greater than a diameter of the supporting shafts of the first spool, the second spool, and the third spool.

5. The ink ribbon cartridge according to claim 1, wherein the fourth spool is in a color different from a color of the first spool, the second spool and the third spool.

6. The ink ribbon cartridge according to claim 1, wherein each of the first spool and the second spool includes a supporting shaft at which each of the first spool and the second spool is supported in the corresponding one of the first opening and the second opening, the supporting shaft having a peripheral surface formed with at least one protrusion for preventing idle rotation of the corresponding one of the first spool and the second spool.

7. The ink ribbon cartridge according to claim 6, wherein the cutout portion is defined by edges, and the at least one protrusions formed to the supporting shaft prevents idle rotation by catching on the cutout portion.

8. The ink ribbon cartridge according to claim 6, wherein each of the first opening and the second opening is defined by an inner surface formed with at least one protrusion for catching on the at least one protrusion of the supporting shaft.

9. The ink ribbon cartridge according to claim 7, wherein each spool has a disk-shaped flange and a portion protruding outward from the corresponding one of the first plate and the second plate, when the case is being placed on a flat surface, the portion of each flange is in contact with the flat surface and the at least one protrusion catches on the edges defining the cutout portion, thereby preventing each flange from rolling across the flat surface.

10. The ink ribbon cartridge according to claim 1, wherein each of the first spool and the second spool has a preventing portion that prevents idle rotation of corresponding one of the first spool and the second spool when the case is placed on a flat surface.

11. The ink ribbon cartridge according to claim 10, wherein each of the spools has a disk-shaped flange having a portion protruding outward from the corresponding one of the first plate and the second plate, the portion of the flange is in contact with the flat surface when the case is being placed on the flat surface, and the preventing portion prevents each flange from rolling across the flat surface.

12. The ink ribbon cartridge according to claim 1, wherein the ribbon unit is detached from or mounted onto the body unit while the first spool and the second spool are detached from the corresponding ones of the first opening and the second opening.

13. An ink ribbon cartridge comprising:

a case having two pairs of a right side plate and a left side plate each formed with an opening with a cutout portion defined by edges; and two pairs of a right spool and a left spool each having a supporting shaft, each of the right spool and the left spool being detachably rotatably mounted in a corresponding opening and each having a disk-shaped flange with a portion protruding outward from the case, the supporting shaft of either one of the right spool and the left spool having a peripheral surface formed with at least one protrusion for catching on the edges defining the cutout portion, wherein when the case is being placed on a flat surface, the portion of each flange is in contact with the flat surface and the at least one protrusion catches on the edges defining the cutout portion, thereby preventing each flange from rolling across the flat surface.

14. The ink ribbon cartridge according to claim 13, wherein the cutout portion is formed at a lower part of the opening, and when the case is being lifted up by a user, and the at least one protrusion formed to the supporting shaft catches on the edges defining the cutout portion, thereby preventing idle rotation of the corresponding one of the right spool and the left spool, and the right spool and the left spool are arranged in a concentric condition with respect to the corresponding openings when the ink ribbon cartridge is mounted in an image forming device.

15. The ink ribbon cartridge according to claim 13, wherein the cutout portion is formed at an upper part of the opening, and when the case is being placed on a flat surface, the at least one protrusion formed to the supporting shaft catches on the edges defining the cutout portion, thereby preventing idle rotation of the corresponding one of the right spool and the left spool.

16. The ink ribbon cartridge according to claim 13, wherein the opening is defined by an inner surface formed with at least one protrusion for catching on the at least one protrusion formed to the supporting shaft.

17. An ink ribbon cartridge comprising:

a case having two pairs of right side plates and left side plates each formed with an opening;

two pairs or right spool and left spools each rotatably mounted in a corresponding opening and each having a disk-shaped flange having a portion protruding outward from a corresponding one of the side plates, wherein the portion of the flange is in contact with a flat surface when the case is being placed on the flat surface, and at least one of the spools is formed with a preventing portion;

a pair of tubes each engaged with a corresponding pair of right spools and left spools; and an ink ribbon wound around the pair of tubes, wherein when the case is placed on the flat surface, the preventing portion prevents idle rotation of the corresponding ones of the right spools and the left spools and also prevents each flange from rolling across the flat surface.

* * * * *